United States Patent [19]

Powers et al.

[11] 4,063,886

[45] Dec. 20, 1977

[54] MERCERIZING COMPOSITIONS

[75] Inventors: John R. Powers, Mount Pleasant; Frances C. Miller, Charleston, both of S.C.

[73] Assignee: Westvaco Corporation, New York, N.Y.

[21] Appl. No.: 691,568

[22] Filed: June 1, 1976

[51] Int. Cl.[2] ..... D06M 1/02

[52] U.S. Cl. ..... 8/127; 252/156

[58] Field of Search ..... 8/127; 252/156, 89; 260/501.1

[56] References Cited

U.S. PATENT DOCUMENTS

| | | | |
|---|---|---|---|
| 1,970,578 | 8/1934 | Schoeller et al. | 8/127 |
| 2,033,125 | 3/1936 | Downing et al. | 8/127 |
| 3,661,787 | 5/1972 | Brown | 252/89 X |
| 3,734,859 | 5/1973 | Ward | 260/501.1 |
| 3,748,267 | 7/1973 | Stokes | 252/89 X |
| 3,956,161 | 5/1976 | Woodward | 252/156 |
| 3,966,628 | 6/1976 | Woodward | 252/156 |

*Primary Examiner*—William E. Schulz

*Attorney, Agent, or Firm*—Richard L. Schmalz; Ernest B. Lipscomb, III

[57] ABSTRACT

Disclosed herein is the mercerization of textiles with a composition comprising an aqueous caustic solution of mercerizing strength containing as a wetting agent at least 0.10% of a mixture of a nonionic surfactant and a polycarboxylic acid or salt thereof of the formula

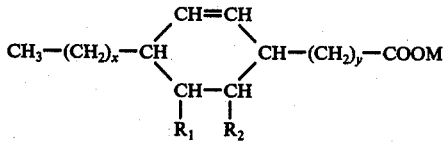

wherein $x$ and $y$ are integers from 3 to 9, $x$ and $y$ together equal 12, $R_1$ and $R_2$ are selected from the group of hydrogen and COOM with at least one of $R_1$ and $R_2$ being COOM, and wherein M is a member of the group consisting of hydrogen, sodium, potassium, lithium and ammonium, the proportion of nonionic surfactant to polycarboxylic acid being between about 1:0.8 to 1:3.

10 Claims, No Drawings

MERCERIZING COMPOSITIONS

BACKGROUND OF THE INVENTION

1. Field of the Invention

This invention relates to the mercerization of textiles. More particularly, this invention relates to mercerizing compositions containing wetting agents comprising polycarboxylic acids or salts thereof and nonionic surfactants.

2. The Prior Art

Mercerizing, mainly carried out on cotton, is to improve luster, smoothness of fabric, dye affinity, stabilization, tensile strength and chemical reactivity. The most obvious and most important reason for using bath assistants is to insure proper and prompt wetting of the caustic on the fibers. Other advantages are that bath assistants penetrate the fibers, and speed up the reaction rate of the caustic with the cellulose, and make removal of the caustic easier when mercerization is complete. The process of mercerizing is named after John Mercer, and a description of Mercer's process is set forth in U.S. Pat. No. 8,303 of 1851. Even in Mercer's early work, the need for thorough wetting of the material to be treated was recognized.

The majority of practical mercerizations are carried out using caustic concentrations between 21% and 25%, but caustic strengths ranging from about 14% to 28% may be used. In conjunction with the strong caustic solution, it is generally desirable to use a wetting agent. The wetting agent dissolved in the caustic increases tremendously its penetrating power and helps to effect rapid and even wetting of the cotton with the caustic. Rapid, uniform, and efficient mercerization of the cotton is thereby made possible.

Most wetting agents cannot be used in the mercerizing process as they are not sufficiently soluble in the strongly caustic solutions. Wetting agents have been generally either of two basic types: phenolic-type compounds, such as cresylic acids, or higher alcohols, glycol ethers and sulfonated hydrocarbons. Numerous other such wetting agents have been suggested, such as nitric acid-treated unsaturated fatty acids, as disclosed in U.S. Pat. No. 2,188,287 to Münz.

In general, wetting agents for mercerizing compositions are employed at approximately 1% concentration, based on the weight of the mercerizing caustic solution. The amount of a good penetrant required for the maximum effect rarely exceeds 2%. Some of the wetting agents used in the prior art have high wetting powers, but usually only over a rather narrow range of caustic concentrations. Other penetrants can be used over a wider range of caustic concentrations, but they have poorer wetting powers.

An object of this invention is to provide an aqueous alkaline solution of mercerizing strength having improved wetting and penetrating properties. Another object of this invention is to provide an improved wetting composition for mercerizing solutions. A further object of this invention is to provide mercerizing solutions for the treatment of textile materials. A more specific object of this invention is to provide mercerizing solutions containing wetting agents comprising certain polycarboxylic acids or salts thereof in combination with nonionic surfactants. Yet another object of this invention is to provide mercerizing solutions containing wetting agents comprising normally alkaline-insoluble nonionic surfactants in combination with polycarboxylic acids. Still another object of this invention is to produce alkaline solutions highly efficient for the mercerization of cotton materials. Other objects, features and advantages of this invention will be evident from the following detailed description of the invention.

SUMMARY OF THE INVENTION

The above objects are accomplished by adding to aqueous caustic solutions of mercerizing strength at least 0.1% by weight of caustic solution of a wetting agent comprising a nonionic surfactant and a polycarboxylic acid or salt thereof having the formula

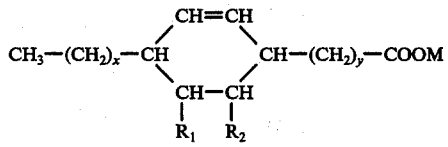

wherein $x$ and $y$ are integers from 3 to 9, $x$ and $y$ together equal 12, $R_1$ and $R_2$ are selected from the group of hydrogen and COOM with at least one of $R_1$ and $R_2$ being COOM, and wherein M is a member of the group consisting of hydrogen, sodium, potassium, lithium and ammonium, the proportion of nonionic surfactant to polycarboxylic acid or its salt being between about 1:0.8 to 1:3, preferably 1:1.2 to 1:1.7.

DETAILED DESCRIPTION OF THE INVENTION

The mercerizing composition of this invention is a strongly caustic aqueous solution containing from 14% to 28% by volume caustic, preferably from 21% to 25%. The caustic used is normally sodium hydroxide, but conventionally used alkaline producers may be employed, such as potassium hydroxide, sodium carbonate and the like.

The wetting composition comprises a mixture of normally alkaline insoluble nonionic surfactant and a cycloaliphatic polycarboxylic or its salt. The components of the wetting agent are normally mixed together and added to the mercerizing solution. At least 0.1% by weight of caustic solution of wetting composition is added. To achieve good wetting, it is usually unnecessary to exceed 2%. The preferred amount of addition is 0.25% to about 1.0%. The proportion of nonionic surfactant to polycarboxylic acid or its salt is from 1:0.8 to 1:3, preferably about 1:1.2 to 1:1.7.

The polycarboxylic acid and salts thereof which are used in this invention have the formula

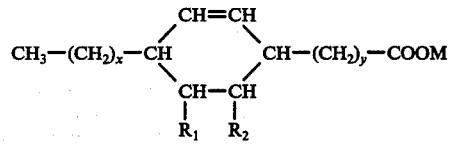

wherein $x$ and $y$ are integers from 3 to 9, $x$ and $y$ together equal 12, $R_1$ and $R_2$ are selected from the group of hydrogen and COOM with at least one of $R_1$ and $R_2$ being COOM, and wherein M is a member of the group consisting of hydrogen, sodium, potassium, lithium and ammonium. When the free-acid form is added to the mercerizing bath, it is converted to its salt form because of the alkali. Thus, since sodium hydroxide is normally used to make mercerizing solutions, the sodium salt is preferred.

In embodiments wherein either $R_1$ or $R_2$ is hydrogen, the polycarboxylic acid is a $C_{21}$-dicarboxylic acid; and the salts thereof are disclosed in U.S. Pat. No. 3,734,859 to Ward and incorporated herein by reference. In embodiments wherein both $R_1$ and $R_2$ are COOM groups, the polycarboxylic acid or its salt is in the form of a $C_{22}$-tricarboxylic acid or salt. These are disclosed in co-pending application Ser. No. 622,254 filed Oct. 14, 1975, and incorporated herein by reference.

The nonionic surfactants can be any of a wide variety of surface active surfactants many of which are insoluble in caustic solutions of mercerizing strength. Suitable nonionic surfactants include broadly linear ethoxylated alcohols and ethoxylated alkyl phenols. More particularly, the nonionics include polyoxyalkylene derivatives of polypropylene glycols, for examples, those sold under the trade name Pluronic by Wyandotte Chemicals Corp., alkylphenoxy poly(oxyethylene) ethanols made by G.A.F. under the trade name Igepal, and straight chain primary aliphatic oxyethylated alcohols such as the Plurafacs also by Wyandotte Chemicals Corp. Additionally, the Neodol type of nonionic surfactant made by Shell Chemical Co. and described as $C_{12}$–$C_{15}$ linear primary alcohol ethoxylates may be used. Also, ethoxylated octyl phenols sold by Rohm and Haas under the trade name Triton may be used. These nonionic surfactants and others useful in the invention are described in McCutcheon's "Detergents and Emulsifiers," 1972 Edition.

The polycarboxylic acid or salt functions primarily to solubilize the normally alkaline-insoluble nonionic surfactant in caustic solutions of mercerizing strength. The nonionic surfactant-polycarboxylic acid or salt wetting compositions when incorporated into caustic mercerizing solutions give superior wetting of textiles, in particular, cotton with the mercerizing solution over a wide range of caustic concentrations and temperatures. Additionally, the wetting compositions do not have the objectionable odors and skin-irritating traits of many wetting agents commonly used in the prior art.

The mercerizing compositions of the present invention maintain their effectiveness for wetting cotton over a rather wide range of operating temperatures and concentrations. Using the preferred 1:1.2 mixture of nonionic surfactant and tricarboxylic acid salt as the wetting agent in mercerizing solutions from 14% to 28% caustic and a temperature from 26° C. to 75° C., good wetting of the cotton was achieved.

The practice of this invention may clearly be seen in the following examples.

EXAMPLE 1

Mixtures of the trisodium salt of a tricarboxylic acid and a nonionic surfactant — a modified ethoxylated straight chain alcohol sold under the trade name Plurafac RA-30, of the compositions indicated in the following table, were prepared. AATCC test method 43–1974 was used to test wettability in a mercerizing solution of 25% sodium hydroxide. All tests were run at room temperature, i.e., 26° C. In this method, a one-inch long bundle of 120 cotton fibers is dropped onto the surface of the solution being tested; and the time in which it takes all of the fibers to become wet is measured. For these tests, a large batch of 25% sodium hydroxide solution was prepared of which 100-milliliter aliquots were used for each specific test. For each run, a predetermined mixture of $C_{22}$-cycloaliphatic tricarboxylic acid salt/nonionic surfactant was added to 100 milliliters of the 25% sodium hydroxide solution and mixed well. In addition to recording the wetting time, observations were made on the physical appearance of the test solution.

TABLE I

| Amount of Test Solution (ml.) | Composition of Wetting Agent: Nonionic Surfactant, % | Trisodium Salt of Tricarboxylic Acid, % | Wetting Speed (sec.) |
|---|---|---|---|
| 0 | 0 | 0 | >180.0 |
| 1.25 | 50 | 0 | insoluble |
| 1.25 | 0 | 50 | >180.0 |
| .75 | 50 | 50 | 24.1 |
| 1.00 | 50 | 50 | 21.8 |
| 1.25 | 50 | 50 | 16.2 |
| .75 | 40 | 60 | 20.9 |
| 1.00 | 40 | 60 | 17.3 |
| 1.25 | 40 | 60 | 17.5 |
| .75 | 36 | 64 | 22.0 |
| 1.00 | 36 | 64 | 19.3 |
| 1.25 | 36 | 64 | 19.7 |

The results show the synergism upon wetting of a mixture of the nonionic surfactant and trisodium salt of tricarboxylic acid.

EXAMPLE 2

This example illustrates the effectiveness of a mercerizing solution on cotton using as a wetting agent a mixture of $C_{21}$-cycloaliphatic dicarboxylic acid and a linear primary alcohol ethoxylate sold under the trade name Neodol 23–6.5 as the nonionic surfactant in a 14% caustic solution.

TABLE II

| Amount of Test Solution % | Composition of Wetting Agent: Nonionic Surfactant, % | Dicarboxylic Acid, % | Wetting Time (seconds) |
|---|---|---|---|
| 0 | 0 | 0 | >90.0 |
| .50 | 0 | 100 | insoluble |
| .50 | 100 | 0 | 180.0 |
| .25 | 38 | 62 | 41.0 |
| .50 | 38 | 62 | 31.0 |
| 1.00 | 38 | 62 | 27.0 |
| .25 | 40 | 60 | 34.5 |
| .50 | 40 | 60 | 24.5 |
| 1.00 | 40 | 60 | 23.0 |
| .25 | 42 | 58 | 61.0 |
| .50 | 42 | 58 | 35.0 |
| 1.00 | 42 | 58 | 34.0 |

The results show the reduced wetting times obtained using the mixture of nonionic surfactant and dicarboxylic acid.

EXAMPLE 3

This example illustrates the effectiveness of the 14% caustic mercerizing solution from Example 2 on orlon. The wettability tests were run as set out in Example 1, and the results are shown in Table III.

TABLE III

| Amount of Test Solution, % | Composition of Wetting Agent: Nonionic Surfactant, % | Dicarboxylic Acid, % | Wetting Time (seconds) |
|---|---|---|---|
| .50 | 0 | 100 | 25.0 |
| | 100 | 0 | insoluble |
| .25 | 42 | 58 | 10.3 |
| .50 | 42 | 58 | 7.7 |
| 1.00 | 42 | 58 | 5.7 |
| .25 | 40 | 60 | 14.1 |
| .50 | 40 | 60 | 8.5 |
| 1.00 | 40 | 60 | 7.0 |
| .25 | 38 | 62 | 11.5 |
| .50 | 38 | 62 | 9.7 |

TABLE III-continued

| Amount of Test Solution, % | Composition of Wetting Agent: Nonionic Surfactant, % | Dicarboxylic Acid, % | Wetting Time (seconds) |
|---|---|---|---|
| 1.00 | 38 | 62 | 60.0 |

The results show the wetting agents to be effective on orlon in mercerizing.

While the invention has been described and illustrated herein by references to various specific materials, procedures and examples, it is understood that the invention is not restricted to the particular materials, combinations of materials, and procedures selected for that purpose. Numerous variations of such details can be employed, as will be appreciated by those skilled in the art.

What is claimed is:

1. In a process for mercerizing textiles, the improvement which comprises adding to an aqueous caustic solution of mercerizing strength, at least 0.10% by weight of caustic solution of a wetting agent which comprises a mixture of a nonionic surfactant and a polycarboxylic acid or salt thereof of the formula

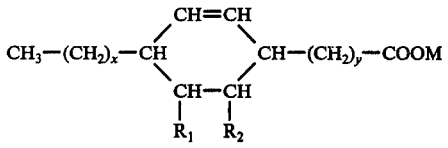

wherein $x$ and $y$ are integers from 3 to 9, $x$ and $y$ together equal 12, $R_1$ and $R_2$ are selected from the group of hydrogen and COOM with at least one of $R_1$ and $R_2$ being COOM, and wherein M is a member of the group consisting of hydrogen, sodium, potassium, lithium and ammonium, the proportion of nonionic surfactant to polycarboxylic acid or salt thereof being between about 1:0.8 to 1:3.

2. The process according to claim 1 wherein said caustic concentration is from 14% to 28% by weight.

3. The process according to claim 1 wherein said caustic concentration is from 21% to 25%.

4. The process according to claim 2 wherein said wetting agent is present in an amount from 0.25% to about 1.0%, and the proportion of nonionic surfactant to polycarboxylic acid is from 1:1.2 to 1:1.7.

5. The process according to claim 4 wherein both $R_1$ and $R_2$ are COOM.

6. The process according to claim 5 wherein M is sodium.

7. The process according to claim 4 wherein only one of $R_1$ and $R_2$ is COOM.

8. The process according to claim 7 wherein M is sodium.

9. The process according to claim 4 wherein said non-ionic surfactant is a member of the group consisting of ethoxylated alcohols and ethoxylated alkyl phenols.

10. The process according to claim 1 wherein said textiles are cotton.

* * * * *